US006606073B1

(12) United States Patent
Visser

(10) Patent No.: US 6,606,073 B1
(45) Date of Patent: Aug. 12, 2003

(54) WAVEGUIDE ARRAY ANTENNA

(75) Inventor: Hubregt Jannis Visser, Den Haag (NL)

(73) Assignee: Nederlandse Organisatie voor toegepast-natuurwetenschappelijk Onderzpek TNO, VK Delft (NL)

( * ) Notice: Subject to any disclaimer, the term of this patent is extended or adjusted under 35 U.S.C. 154(b) by 0 days.

(21) Appl. No.: 09/958,279

(22) PCT Filed: Apr. 4, 2000

(86) PCT No.: PCT/NL00/00220

§ 371 (c)(1),
(2), (4) Date: Nov. 7, 2001

(87) PCT Pub. No.: WO00/60700

PCT Pub. Date: Oct. 12, 2000

(30) Foreign Application Priority Data

Apr. 6, 1999 (NL) ..... 1011735

(51) Int. Cl.[7] ..... H01Q 13/10
(52) U.S. Cl. ..... 343/771; 343/776
(58) Field of Search ..... 343/771, 909, 343/753, 754, 872, 776, 778, 779

(56) References Cited

U.S. PATENT DOCUMENTS 4,314,255 A 2/1982 Kornbau ..... 343/909
5,243,357 A * 9/1993 Koike et al. ..... 343/776

FOREIGN PATENT DOCUMENTS

GB 1 535 954 12/1978

OTHER PUBLICATIONS

Arndt et al., "Generalized Moment Method Analysis of Planar Reactively Loaded Rectangular Waveguide Arrays," *IEEE Transactions on Antennas and Propagation*, 37 (3), pp. 329–338 (XP–002123735) (Mar. 1989).

Rope et al., "An Angle Filter Containing Three Periodically Perforated, Metallic Layers," *1979 International Symposium Digest, Antennas and Propagation*, 2, pp. 818–820 (XP–002123734) (Jun. 1979).

Visser et al., "CAD of Waveguide Array Antennas Based on "Filter" Concepts," *IEEE Transactions on Antennas and Propagation*, 47(3), pp. 542–548 (XP–000830215) (Mar. 1999).

Rope et al., "Metallic, Angular Filters for Array Economy," *AP–S International Symposium 1976*, pp. 155–157 (XP–002123736) (Oct. 1976).

* cited by examiner

*Primary Examiner*—James Clinger
(74) *Attorney, Agent, or Firm*—Leydig, Voit & Mayer Ltd.

(57) ABSTRACT

A waveguide array antenna is composed from a number of open waveguides lying in one plane on the radiation side, of which a part is fed on the reverse side thereof, while the other ones are closed off. On the radiation side there is provided at least one two-layer structure, integrated with the open waveguides and consisting of a dielectric layer and a perforated, electrically conductive layer, in which two-layer structure, together with the layer or the face on which this two-layer structure has been provided, a periodically repeating electromagnetic resonance pattern can be generated in parallel directions relative to said face, of which the energy, outputted via the perforations, forms a transmission beam.

11 Claims, 2 Drawing Sheets

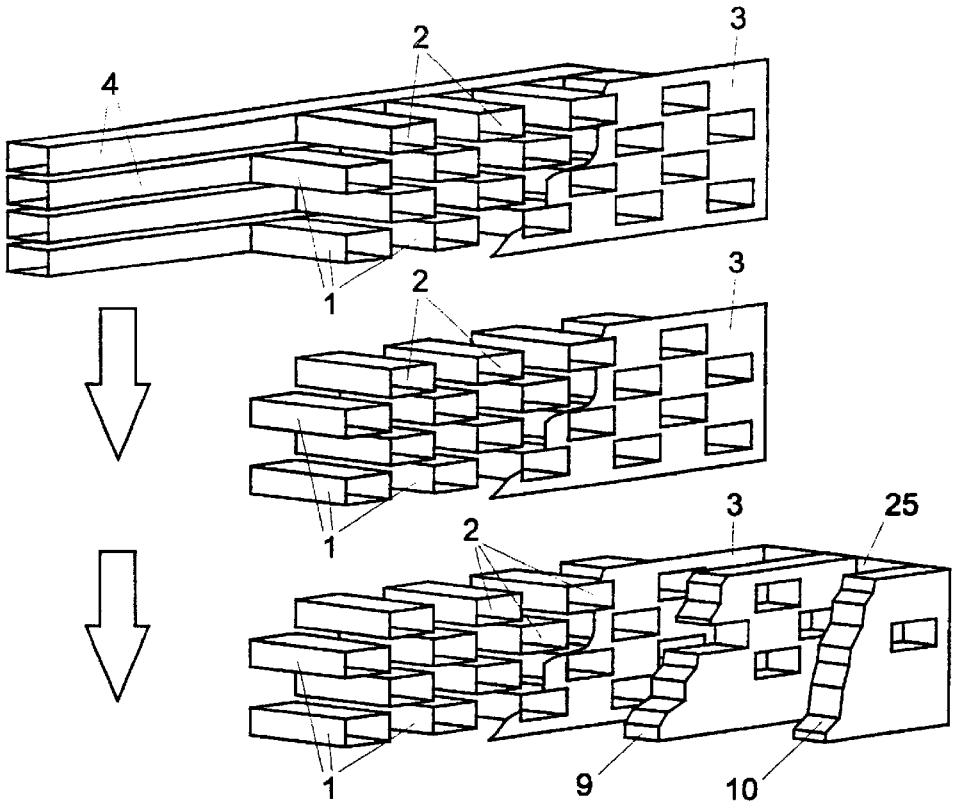
Fig. 1A
Fig. 1B
Fig. 1C
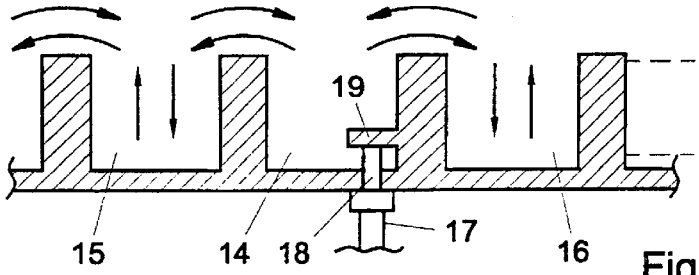
Fig. 2
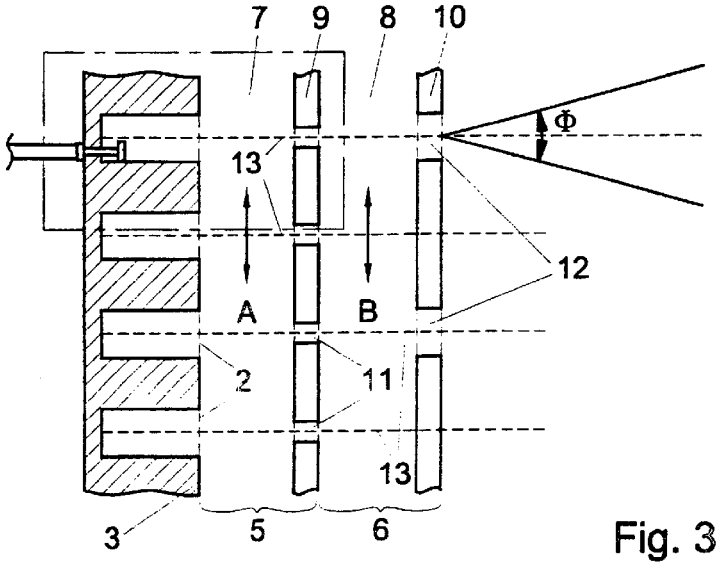
Fig. 3

WAVEGUIDE ARRAY ANTENNA

FIELD OF THE INVENTION

The present invention relates to a waveguide array antenna, composed from a number of open waveguides lying in one plane on the radiation side, of which a part is fed on the reverse side thereof, while the other ones are closed off.

BACKGROUND OF THE INVENTION

Antennas of this type are typically referred to as reactively loaded waveguide array antennas. The open waveguide ends of the antennas need not lie in a flat plane, a curved plane or a faceted plane is possible as well. The waveguides in the array have their open ends periodically positioned in such plane. Through a mutual coupling, the non-fed waveguides constitute separate radiation elements, while due to the interaction between these radiation elements, a directional beam can be realized. Said plane may also be materially present in the form of a plate of the same material as the waveguides. The waveguides are short-circuited on the reverse side by means of a closure. The length of the waveguides, i.e. the distance from the short-circuit to the open end of the waveguides, influences the phase adjustment of the wave pattern in the opening thereof and in that of adjacent waveguides and, accordingly, the direction of the beam to be transmitted. Since the present invention relates to a passive antenna, the same applies to the receiving situation as to the transmitting situation, on account of the reciprocity principle. Hereinbelow, only the transmitting situation will be referred to.

A waveguide array antenna as referred to above is known from, for instance, an article by F. Arndt et al.: *Generalized Moment Method Analysis of Planar Reactively Loaded Rectangular Waveguide Arrays,* IEEE Transactions on Antennas and Propagation, Vol. 37, No. 3, Mar. 1989, pp. 329–338. In particular in FIG. 6 of this article, it is indicated how an antenna beam widens if instead of all waveguide array elements, only one is fed. In the case of an array antenna having a fixed beam alignment, the feed of all waveguides is laborious, requiring a complicated distribution network which involves considerable losses in the array antenna, and renders the antenna rather voluminous, heavy and expensive. In the case of an array antenna having variable beam alignment, a phase adjustment of the separate waveguide radiation elements should be performed by means of mechanical or electronic phase shifters and a so-called beam steering computer. This, too, is an expensive solution. It is true that the feeding of only a few waveguides and the short-circuiting of the other waveguides meets these drawbacks, but the result is a considerably wider beam, as a consequence of which, when used in a radar apparatus, the accuracy in determining target coordinates and following a target by means of the radar beam becomes far less accurate. Further, the electromagnetic behavior of the two known types of array antennas is virtually identical.

BRIEF SUMMARY OF THE INVENTION

The object of the invention is to prevent the above-mentioned drawbacks at least to a large extent and to provide a reactively loaded waveguide array antenna whereby a narrow beam can be obtained all the same.

To that end, in accordance with the invention, the waveguide array antenna as described in the preamble is characterized in that on the radiation side at least one two-layer structure is provided, integrated with the open waveguides and consisting of a dielectric layer and a perforated, electrically conductive layer, in which two-layer structure, together with the layer or the face on which this two-layer structure has been provided, a periodically repeating electromagnetic resonance pattern can be generated in parallel directions relative to said face, of which the energy, outputted via the perforations, forms a transmission beam. In this respect. the two-layer structure constitutes a so-called angular filter.

U.S. Pat. No. 4,169,268 discloses a waveguide array antenna wherein all open waveguides are fed on the reverse side thereof, so that the advantages of the array antenna in the article cited and of the array antenna according to the invention are not obtained. It is true that in this US patent, a number of two-layer structures are provided behind the antenna, but these two-layer structures are not integrated with the open waveguides. These two-layer structures are meant to be positioned in front of an antenna—array antenna, parabolic antenna or another type of antenna.

Further, in accordance with the invention, the open waveguides and the two-layer structure are integrated with each other by means of a matching structure present between the open waveguides and the two-layer structure. This realizes an adaptation of the waves guided through the waveguides to waves propagating in the space—through the two-layer structure—and the other way round. Hence, there is an adaptation both to the angular filter and to the input structure formed by the waveguides.

By giving this matching structure frequency-filtering properties, the antenna behavior can further be influenced in a desired manner.

An efficient array antenna is obtained when the matching structure and the two-layer structure are surrounded, parallel to the main axis of the antenna—by electrically conductive limiting elements. Contrary to the US patent cited, where the two-layer structure is surrounded by radiation-absorbing material, when electrically conductive limiting elements, in particular plates, are used, all energy is radiated forwards. No energy losses caused by absorption occur; the limiting elements form, as it were, one large waveguide.

The perforations in the electrically conductive layer are equally spaced apart and aligned with corresponding waveguide openings. However, the number of perforations need not correspond to the number of waveguide openings.

The features mentioned boil down to the introduction of a so-called angular filter, i.e. a waveguide filter in the angular domain, while substantially energy is transmitted in an angular interval, defined by angular values relative to the center line of a beam to be transmitted. The direction of this center line is defined by the phase adjustment of the waveguides. Such angular filter can be designed as low-pass angular filter, in which case a beam can be obtained whose beam width may be considerably smaller than that of a waveguide array antenna without said two-layer structure acting as angular filter. Such angular filter can also be designed as angular band filter, in which case a conical beam having an annular section is obtained.

In particular, a narrow beam can be obtained when several two-layer structures are provided on top of each other, with the periodicity of the perforations in an electrically conductive layer of such two-layer structure being a fraction or a multiple of the periodicity in an electrically conductive layer of an adjoining two-layer structure and the dimensions of the perforations in adjacent electrically conductive layers differing per layer.

BRIEF DESCRIPTION OF THE DRAWINGS

The invention will now be further explained with reference to the accompanying drawings. In these drawings:

FIGS. 1A, B and C show the evolution towards a reactively loaded waveguide array antenna having two two-layer structures possessing angular filter properties, according to the invention;

FIG. 2 shows a section of three juxtaposed waveguides of which only the central one is fed;

FIG. 3 schematically shows a section of an antenna having two two-layer structures according to the invention.

DETAILED DESCRIPTION OF THE DRAWINGS

Figure 4:
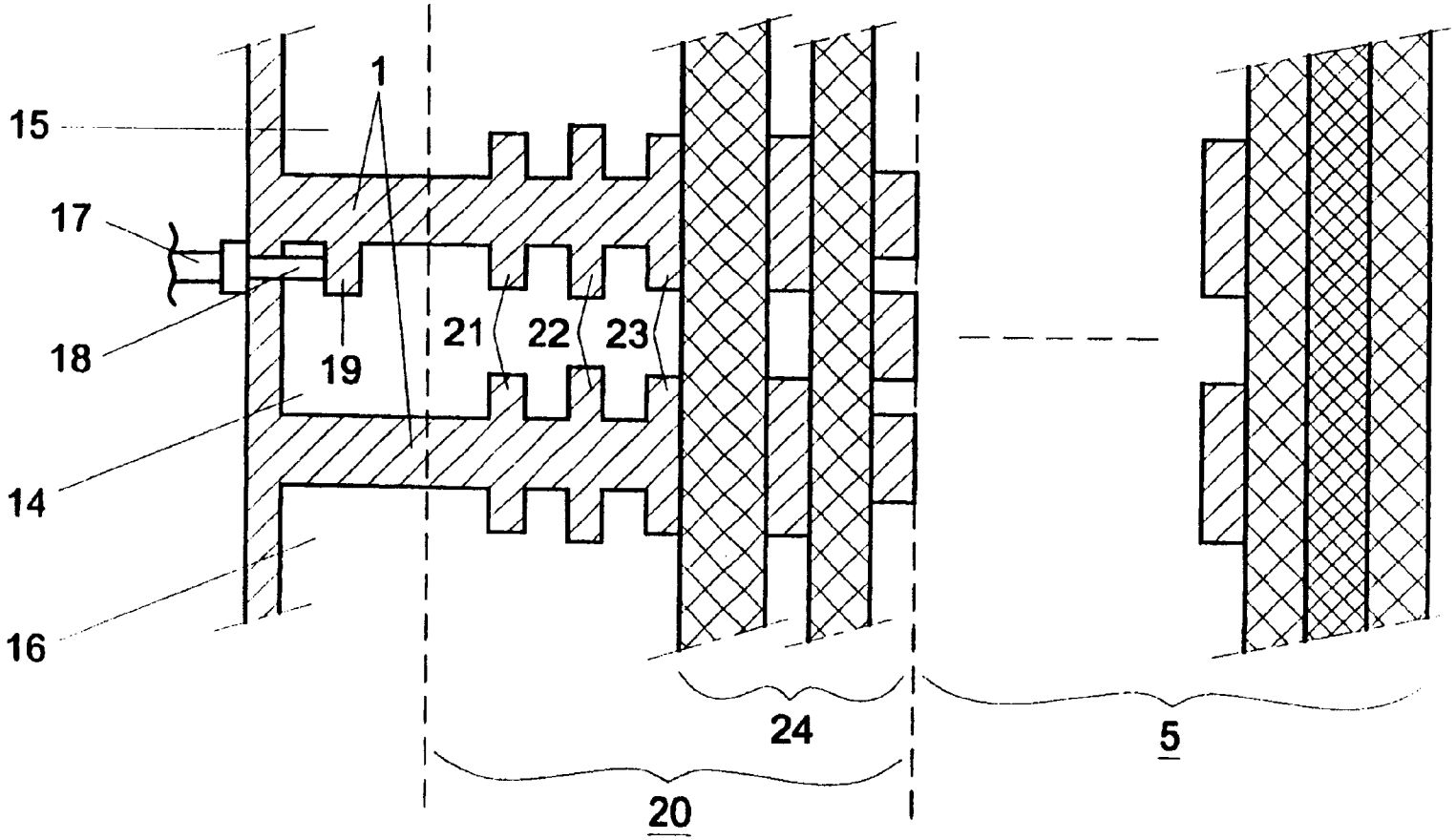
FIG. 4 shows a detail, depicted in broken lines in FIG. 3, of an antenna according to the invention.

FIG. 1A shows a waveguide array antenna built up from waveguides 1 whose open ends 2 lie in a plane 3. This plane is formed by a plate of the same material as that of the waveguides 1. In FIGS. 1A–C, the waveguides 1 are provided perpendicularly to the plate 3 in alternately staggered arrangement. However, they may also be arranged in rows and columns below and next to one another, which is the case in the sections of FIGS. 2 and 3. In the embodiments shown, the waveguides have the same lengths. In FIG. 1A, all waveguides 1 are fed via waveguides 4. The plate 3 with the openings 2 present therein forms the front side of the waveguide array antenna from which a relatively narrow beam can be transmitted. However, when many hundreds or even thousands of waveguides 1 are present, the presence of the feed and distribution system which comprises the waveguides 4 is experienced as a substantial disadvantage. For that reason, the control of only a few waveguides has been changed to, in which case the other waveguides are short-circuited by closing off the rear side. This situation is shown in FIG. 1B. Through mutual coupling, each opening 2 will act as a radiation element, and to obtain a desired beam direction in the openings 2 the phase adjustment suitable therefore should be present. This phase adjustment is effected through the choice of the length of the waveguides or of the distance at which the short-circuits have been provided from the openings 2. As stated, in the exemplary embodiments shown, the wave guides are of equal length; in practice, the lengths will be different. For obtaining a beam perpendicular to plane 3, however, the different lengths will be identical mirror-symmetrically relative to the central antenna axis. In the situation of FIG. 1B, this beam is wider than in the antenna system depicted in FIG. 1A. To obtain a relatively narrow beam all the same, two two-layer structures 5 and 6 have been provided in front of the plate 3. The two-layer structures 5 and 6 comprise a dielectric layer 7 and 8 respectively, in the exemplary embodiments shown a layer of air, and an electrically conductive layer 9 and 10 respectively. Provided in the electrically conductive layer 9 are perforations 11 of the same size, and provided in the electrically conductive layer 10 are perforations 12 likewise of the same size. The perforations 11 are provided directly opposite the openings 2 and the perforations 12 are provided directly opposite half of the openings 11. The openings 2, the perforations 11 and the perforations 12 differ in size and number relative to each other. In any case, they are arranged in a regular manner, such that in the space A formed by the plate 3 and the two-layer structure 5, and the space B formed by the electrically conductive layer 9 and the two-layer structure 6, there is obtained an electromagnetic resonance pattern repeating itself in both transversal directions. In the manner in which energy is introduced from the openings 2 into the space A, energy is introduced via the perforations 11 into the space B and outputted via the perforation 12, through the phase adjustments of the waveguides, in the form of a directed beam. Said resonance pattern can be described as coming from a number of mutually identical, juxtaposed virtual vibration spaces. In FIG. 3, the virtual partition walls of the sections forming the vibration spaces are designated by 13. In the longitudinal direction, each section can be seen as a transmission circuit that can be formed in the usual manner by inductions L and capacities C. In the free space, these inductions and capacities have not only become frequency-dependent, but also angle-dependent. Accordingly, an angular filter can thus be obtained where the outputted energy is kept within a given angular value 4 and a directional beam is obtained which is nevertheless sufficiently narrow, in spite of the fact that only a few waveguides are fed. Through the provision of several two-layer structures, the band width of the angular filter is further limited and an even more narrow beam is obtained.

FIG. 2 further indicates the manner of feeding a waveguide 14 and, by arrows, the outputting of electromagnetic energy to adjacent waveguides 15 and 16. The waveguide 14 is fed via a coax connection 17 whose inner cable 18 contacts, through the waveguide closure, a post 19 on the inner wall of the waveguide 14, to form a closed circuit through the waveguide 14, the post 19 and the inner cable 18 and, as a result, an electromagnetic field is generated in the waveguide 14.

FIG. 4 shows a detail designated by interrupted lines in FIG. 3. This detail shows a part of the matching structure 20 between the open waveguides 1 and the two-layer structure 5. By means of this matching structure 20, the open waveguides 1 and the two-layer structure 5 are integrated with each other, the matching structure having frequency-filtering properties. The matching structure 20 comprises the end of the open waveguides 1, where it is provided with frequency filtering elements 21 and 22 and an element 23 defining a specific aperture, by means of which an adaptation to the two-layer structure 5 is obtained. The joint aperture-defining elements 23 form an electrically conductive plate 3. Provided hereon is a dielectric layer 24 by means of which a further adaptation to the two-layer structure 5 is obtained. The layer 24 need not solely consist of a dielectric layer, but may also, as indicated in FIG. 4, be a combination of a dielectric layer and one or more two-layer structures. It is observed that each dielectric layer of the two-layer structure may again be built up of several layers of a different dielectricity.

It is further observed that matching structure 20 and the two-layer structures are surrounded, parallel to the main axis of the antenna, by electrically conductive limiting elements in the form of four plates. These plates form, as it were, one large waveguide of rectangular section. Only in FIG. 1C, one of the four plates is indicated, viz. by reference numeral 25.

The invention is not limited to the embodiments described hereinabove with reference to the drawings, but comprises various modifications hereof, of course in so far as they fall within the protective scope of the following claims. Thus, it is possible that, for instance, of a few thousands of waveguides 1, tens are fed while the other ones are short-circuited. In that situation, it is possible that the radiated waveguides and, accordingly, the direction of the transmitted beam, are phase-controlled all the same.

The invention is neither limited to embodiments having rectangular waveguides. Embodiments having square, ridged, circular and elliptic waveguides are likewise possible. Further, the invention need not remain limited to a singular polarization. Two orthogonal polarizations are, for instance, possible by giving the feed of the waveguide 14 a double design, with the provision of a second post on a wall which is perpendicular to the wall supporting the first post.

What is claimed is:

1. A waveguide array antenna, composed from a number of open waveguides lying in one plane on a radiation side, at least one two-layer structure comprising a dielectric layer and a perforated, electrically conductive layer being provided on the radiation side, wherein:

a portion of the total number of the open waveguides is fed on a reverse side thereof, while the other ones are closed off, the at least one two-layer structure being integrated with the open waveguides, so that a periodically repeating electromagnetic resonance pattern is generated together in the two-layer structure and a face of the radiation side of the waveguides on which the two-layer structure has been provided, in parallel directions relative with the face, of which the energy of the resonance pattern, outputted via the perforations, forms a transmission beam.

2. The waveguide array antenna according to claim 1, wherein the open waveguides and the two-layer structure are integrated with each other by means of a matching structure present between the open waveguides and the two-layer structure.

3. The waveguide array antenna according to claim 2, wherein the matching structure has frequency-filtering properties.

4. The waveguide array antenna according to claim 2, characterized in that the matching structure and the two-layer structure are surrounded, parallel to the main axis of the antenna, by electrically conductive limiting elements forming a surrounding waveguide.

5. The waveguide array antenna according to claim 1, wherein the perforations in the electrically conductive layer are equally spaced apart and aligned with corresponding waveguide openings.

6. The waveguide array antenna according to claim 1, wherein several two-layer structures are provided on top of each other, with the periodicity of the perforations in an electrically conductive layer of such two-layer structure being a fraction or a multiple of the periodicity in an electrically conductive layer of an adjoining two-layer structure and the dimensions of the perforations in adjacent electrically conductive layers differing per layer.

7. The waveguide array antenna according to claim 3, wherein the matching structure and the two-layer structure are surrounded, parallel to the main axis of the antenna, by electrically conductive limiting elements forming a surrounding waveguide.

8. The waveguide array antenna according to claim 2, wherein the perforations in the electrically conductive layer are equally spaced apart and aligned with corresponding waveguide openings.

9. The waveguide array antenna according to claim 3, wherein the perforations in the electrically conductive layer are equally spaced apart and aligned with corresponding waveguide openings.

10. The waveguide array antenna according to claim 2, wherein several two-layer structures are provided on top of each other, with the periodicity of the perforations in an electrically conductive layer of such two-layer structure being a fraction or a multiple of the periodicity in an electrically conductive layer of an adjoining two-layer structure and the dimensions of the perforations in adjacent electrically conductive layers differing per layer.

11. The waveguide array antenna according to claim 3, wherein several two-layer structures are provided on top of each other, with the periodicity of the perforations in an electrically conductive layer of such two-layer structure being a fraction or a multiple of the periodicity in an electrically conductive layer of an adjoining two-layer structure and the dimensions of the perforations in adjacent electrically conductive layers differing per layer.

* * * * *